United States Patent [19]

Demas

[11] Patent Number: 4,749,901

[45] Date of Patent: Jun. 7, 1988

[54] ELIMINATION OF EXHAUST TUBE RELIEF IN PRESS-SEALED LAMP

[75] Inventor: Nickolas P. Demas, Cranford, N.J.

[73] Assignee: Cooper Industries, Houston, Tex.

[21] Appl. No.: 893,757

[22] Filed: Aug. 6, 1986

[51] Int. Cl.[4] ..... H01J 9/32

[52] U.S. Cl. ..... 313/315; 313/318; 65/59.26; 445/27

[58] Field of Search ..... 445/26, 43, 39, 27; 65/59.23, 59.26, 59.32; 313/318, 623, 315

[56] References Cited

U.S. PATENT DOCUMENTS

| | | | |
|---|---|---|---|
| 3,904,909 | 9/1975 | Vause | 445/26 X |
| 3,979,627 | 9/1976 | Leadvaro et al. | 313/318 |
| 4,028,577 | 6/1977 | Gates et al. | 313/318 |
| 4,243,907 | 1/1978 | Kohl et al. | 313/318 |
| 4,469,983 | 9/1984 | Grahmmann et al. | 445/27 |
| 4,603,278 | 7/1986 | Devir et al. | 313/318 |

FOREIGN PATENT DOCUMENTS

| | | | |
|---|---|---|---|
| 217078 | 1/1985 | German Democratic Rep. | 313/623 |
| 46441 | 3/1982 | Japan | 445/27 |

*Primary Examiner*—Kenneth J. Ramsey

*Attorney, Agent, or Firm*—E. E. Scott; A. R. Thiele

[57] ABSTRACT

A process for manufacturing an incandescent lamp includes evacuating the lamp through a hollow space formed in the lower portion of the lamp to be sealed by press jaws and sealing the lamp with press jaws whose surface is substantially flat.

6 Claims, 1 Drawing Sheet

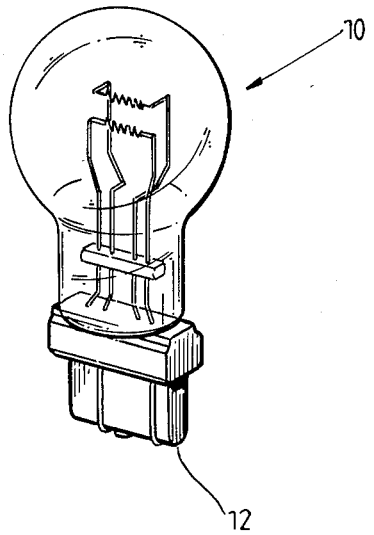
Fig. 1
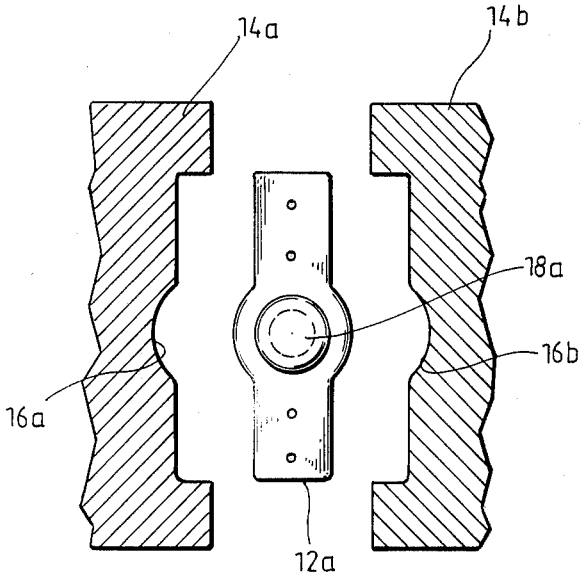
Fig. 2
(PRIOR ART)
Fig. 3
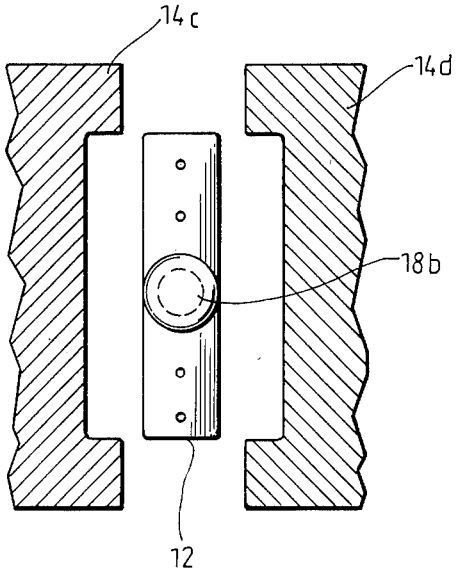

ELIMINATION OF EXHAUST TUBE RELIEF IN PRESS-SEALED LAMP

BACKGROUND OF THE INVENTION

The present invention relates to the manufacture of incandescent lamps, more specifically, the present invention relates to the manufacture of incandescent lamps having a press-sealed base.

For many years incandescent lamps used in automobiles have been mounted in sockets by means of metal bases formed as a part of the lamp. For some time now, the use of baseless press-sealed lamps has become common in automotive applications. The elimination of the metal base and the manufacturing machinery needed to attach the metal base to the lamp have resulted in substantial cost savings.

Until very recently the use of baseless press-sealed lamps in automotive applications has been confined to those lamps having a single filament. The key difficulty in developing a baseless press-sealed dual filament lamp has been the lack of a practical means of securing the lamp to a mounting socket in the automobile. Such difficulty is caused by the semi-cylindrical hump appearing on either side of the flattened base portion of a baseless press-sealed lamp. This semi-cylindrical hump is formed on the base during the manufacturing process to maintain an internal passageway for the evacuation of gases from the bulbous portion of the lamp.

The presence of this semi-cylindrical hump, necessitated by the need for a gas evacuation passageway, creates difficulties in the design of an appropriate socket for baseless dual filament press-sealed lamps. These difficulties are caused by the limited space available for the terminals necessary to make electrical connections to the lamp. There is, therefore, a need in the art to develop a way to manufacture baseless press-sealed incandescent lamps that do not have a semi-cylindrical hump on either side of the flattened portion of the press-sealed lamp base.

SUMMARY OF THE INVENTION

The manufacture of the incandescent lamp of the present invention consists of evacuating the contents of the bulbous portion of the lamp through a hollow or tubular space formed in the lower or base portion of the lamp. In the prior art, it has been necessary to provide a relief or semi-cylindrical recess in the press jaws to allow for the forming of a tubular passageway in the flattened base which permits the passage of evacuate from the lamp. It has been discovered that the provision of the exhaust tube relief or semi-circular recess in the press jaws is unnecessary if a flow of cooling gas is maintained through the exhaust tube while the bulb neck is being melted in preparation for pressing. The opening in the exhaust tube is retained in the base of the lamp during pressing while still permitting the outer wall of the exhaust tube to melt and join hermetically with the bulb glass used to form the press. In this way the bulbous portion of the lamp can be properly evacuated while forming a press-sealed base without a hump on either side.

Accordingly, by the method of the present invention the need to provide a relief in the press jaws and thus form a semi-circular hump on either side of the press-sealed base has been eliminated.

BRIEF DESCRIPTION OF THE DRAWINGS

A better understanding of the present invention may be had by reference to the drawings wherein:

FIG. 1 is a perspective view of an incandescent lamp formed according to the present invention including a collar which provides for mounting the incandescent lamp in a socket.

FIG. 2 is a bottom view of a lamp being formed according to the prior art; and FIG. 3 is a bottom view of a lamp being formed according to the present invention.

DETAILED DESCRIPTION OF THE PREFERRED EMBODIMENTS

Incandescent lamps 10 having a press-sealed base 12 have been found to be the most economical types of lamps for use by the automobile industry. This is because there is no need to include a separate metallic base affixed to the bottom of the lamp 10 for making electrical connections.

Many automobile applications require dual filament lamps. The main drawback to the use of dual filament baseless press-sealed lamps has been the development of a suitable socket for mounting the lamp. Standing in the way of suitable socket development has been the press formed base of the lamp which by necessity has included a semi-cylindrical hump on either side. These humps were thought to be essential to permit evacuation of the bulbous portion of the lamp during manufacture.

FIG. 2 demonstrates the formation of the semi-cylindrical hump on either side of the base 12*a* of prior art lamps. Press jaws 14*a* and 14*b* were used to press and seal base 12*a* of the lamp. Included in press jaws 14*a* and 14*b* were a pair of semi-circular reliefs 16*a* and 16*b* which, when pressed into base 12*a* of the lamp, permitted the glass in base 12*a* to form a hermetic seal and an exhaust tube to permit the passage of evacuate from the bulbous portion of the lamp. This exhaust tube relief presented significant problems in the design of a socket for those using the baseless press-sealed lamps.

It has now been discovered that the relief portion 16*a* and 16*b* in press jaws 14*a* and 14*b* shown in FIG. 2 can be eliminated without affecting the ability of evacuate to exit the bulbous portion of the lamp. Accordingly, flat press jaws 14*c* and 14*d* may be used instead of the prior art press jaws 14*a* and 14*b* shown in FIG. 2. Note that press jaws 14*c* and 14*d* do not include semi-circular reliefs 16*a* and 16*b*. The patency of hollow space 18*b* in the molten glass is maintained solely by the flow of cooling as either into the bulbous portion of the lamp during sealing and forming of the press. Accordingly, a lamp 12 made according to the process of the present invention will not include the semi-cylindrical humps on either side of the flattened base portion of the lamp.

A lamp made according to the foregoing process may be conveniently used in a socket by placing a collar over the lower portion of the lamp and reverse bending the electrical leads from the filament back up along the sides of the base portions of the lamp and into the collar. Such construction is shown in FIG. 1. The lamp and the collar may then be inserted into a socket wherein the necessary electrical connection may be made to cause the filament to glow, thus illuminating the lamp.

It will be evident to those skilled in the art that various changes, modifications and omissions may be made to the disclosed process while still in keeping with the spirit and scope of the invention as defined in the appended claims.

I claim:

1. A process for manufacturing a baseless incandescent lamp having a bulbous portion and a flattened base comprising the steps of:

evacuating said lamp through a hollow space formed in the flattened base;

press sealing the flattened base said lamp closed with press jaws whose pressing surface is substantially flat;

whereby the flow of a cooling gas through said hollow space will maintain the patency of said hollow space without providing a relief in said press jaws.

2. A baseless incandescent lamp formed according to the steps of claim 1.

3. The process as defined in claim 1 further including the step of press sealing the electrical connections to the filament of the incandescent lamp in the flattened base while a cooling gas is flowing through the exhaust tube.

4. The baseless incandescent lamp as defined in claim 2 further including a support collar for positioning the incandescent lamp in a socket.

5. The baseless incandescent lamp as defined in claim 4 wherein the electrical connections to the filament of the incandescent lamp are reversed bended along said flattened base.

6. The baseless incandescent lamp as defined in claim 5 wherein the bulbous portion of the lamp contains a plurality of filaments.

* * * * *